US005588626A

United States Patent [19]

Yang

[11] Patent Number: 5,588,626

[45] Date of Patent: Dec. 31, 1996

[54] FLEXIBLY ADAPTABLE AND REMOVABLE CABLE WINDING AND COLLECTING APPARATUS

[75] Inventor: Dah-Rong Yang, Tao-Yuan, Taiwan

[73] Assignee: Delta Electronics, Inc., Taipei, Taiwan

[21] Appl. No.: 442,315

[22] Filed: May 16, 1995

[51] Int. Cl.[6] ..... B65H 75/48

[52] U.S. Cl. ..... 242/378.1

[58] Field of Search ..... 242/378.1, 378.2, 242/378.3, 388.1, 388.5

[56] References Cited

U.S. PATENT DOCUMENTS

| | | | |
|---|---|---|---|
| 1,361,465 | 12/1920 | Johnson | 242/378.3 |
| 2,206,352 | 7/1940 | Hellmann | 242/378.2 |
| 3,224,706 | 12/1965 | Bastow | 242/378.1 |
| 3,474,985 | 10/1969 | Brudi et al. | 242/378.3 |
| 3,601,331 | 8/1971 | Frey | 242/378.3 |
| 4,053,118 | 10/1977 | Aikins | 242/378.2 |

FOREIGN PATENT DOCUMENTS

| | | | |
|---|---|---|---|
| 451310 | 5/1950 | Italy | 242/378.1 |

*Primary Examiner*—John M. Jillions
*Attorney, Agent, or Firm*—Bo-In Lin

[57] ABSTRACT

The present invention discloses a wire winding and collecting device for winding and collecting a long string wire. The winding and collecting device includes a spring for asserting a rotation force. The winding and collecting device further includes a bi-level both-end type of wire collector which includes a bottom collecting ridge and a top collection ridge divided by a dividing surface. The dividing surface includes an opening for inserting the wire therethrough at a mid-point on the wire for wrapping a first portion of the wire around the bottom collecting ridge and a second portion opposite the first portion from the mid-point around the top collecting ridge. The winding and collecting device further includes a rotation axial shaft inserted through an axial opening disposed on the central portion of the spring and the collector. The spring asserts a rotation force on the bottom collect ridge to rotate for collecting the wire from a first end of the wire and the spring further asserts a rotation force on the top collecting ridge to rotate for collecting the wire from a second end of the wire opposite the first end.

8 Claims, 4 Drawing Sheets

FLEXIBLY ADAPTABLE AND REMOVABLE CABLE WINDING AND COLLECTING APPARATUS

BACKGROUND OF THE INVENTION

1. Field of the Invention

This invention relates generally to a revolvable device for winding and collecting cables or cord thereon. More particularly, this invention relates to a conveniently and flexibly adaptable and removable apparatus for winding and collecting cables, cords, or ropes thereon.

2. Description of the Prior Art

The winding of electrical cords or cables for storage after use of an electrical device, especially for portable computers or mobile appliances such as a vacuum cleaner or electrical chain saw, often becomes an awkward and unpleasant task. This is particularly true when the cables or cords are very long and easily entangled. For that reason, appliances or portable electronic devices which are better designed are often provided with an automatic cord-winding collector. A user of these types of devices or appliances no longer needs to bother with the task of handling very long and entangled cords.

FIGS. 1 shows such a prior art automatic cord-winding collector 10 for a portable computer. The cord-winding collector 10 includes a DC output cable 15 providing a DC voltage generated by an AC-to-DC adapter (not shown) for connecting to a portable computer. The cord-winding collector 10 also includes a top cover 20, a bottom chassis 30 for containing the wire collector therein. The cord-winding collector also has a spindle 40 and a cable-winder 50 for winding the cable 15 thereon. In odder to maintain electrical connection during the winding of the cable 15, the cable 15 is electrically connected to two contact plates 55 and 60 which serve as the positive and negative electrodes for maintaining constant contact with a circular contact trace 70 disposed on top of the contact plates 55 and 60. This type of cord-winding collector is well known and broadly applied in electrical devices where AC connections are employed for providing power supply to the devices. However, the contact points of the contact plates 55 and 60 with the circular contact trace generate additional resistance to the circuits providing the input power to the devices. This type of wire collector generally provide acceptable performance for devices applying AC input voltages. e.g., vacuum cleaner or chain saw. However, for other type of devices which require a DC voltage input, e.g., a portable computer, the additional resistance generated by such contacts may produce undesirable effects to both the performance and reliability.

Other than the problems for a wire winding collector applied to a DC power supply device for a notebook computer or other mobile electrical appliances as described above, most of the conventional cord-winding collectors are manufactured as a built-in mechanism for use by that particular computer or appliance only. For these appliances and devices which do no include a built-in wire winding and collecting mechanism, the tasks of handling long and entangled wires, cables, cords, or ropes after and before use still remain time-consuming chores to be repetitively performed whenever longer wires, cords or ropes are used.

Therefore, a need still exists for a new automatic-winding collector which is flexibly adaptable for application to different wires, cords, cables, or ropes in order to resolve these difficulties and limitations. Specifically, this new adapter design and configuration must be able to provide space savings and operation conveniences to satisfy modern applications for use in portable and mobile electronic devices and equipment wherein DC power supply is required, e.g., a portable computer with mobile office peripherals such as a scanner and printer. Additionally, it is desirable that this new collector can be easily adaptable for winding and collecting wires, ropes or cores where there are no built-in winding and collecting devices before or after their use.

SUMMARY OF THE PRESENT INVENTION

It is therefore an object of the present invention to provide a new automatic-winding collector which is flexibly adaptable to and removable from wires, cords, cables, or ropes in order to overcome the aforementioned difficulties encountered in the prior art.

Specifically, it is an object of the present invention to provide a new automatic-winding collector which is flexibly adaptable to and removable from wires, cords, cables, or ropes to achieve space saving and operational conveniences.

Another object of the present invention is to provide a new automatic-winding collector which is flexibly adaptable to and removable from wires, cords, cables, or ropes in order to save time and efforts of a user in handling and storing very long and entangled wires, cords, cables, or ropes after use.

Another object of the present invention is to provide a new automatic-winding collector which is flexibly adaptable to and removable from electrical cords for application to a DC-source electronic device such as a portable computer in order to improve the reliability and performance.

Another object of the present invention is to provide a new automatic-winding collector which is flexibly adaptable to and removable from wires, cords, cables, and ropes, such that the system design can be simplified without requiring to design a cord collector as a built-in mechanism as part of the original system.

Briefly, in a preferred embodiment, the present invention includes a flexibly adaptable and removable wire winding and collecting apparatus for winding and collecting a long string wire therein. The winding and collecting apparatus includes a rotation force asserting means for asserting a rotation force. The winding and collecting apparatus further includes a bi-level both-end collecting means including a bottom collecting means and a top collection means divided by a dividing surface wherein the dividing surface including a flexibly adapting and removing opening for adapting the wire therethrough at a mid-point on the wire for wrapping a first portion of the wire around the bottom collecting means and a second portion opposite the first portion from the mid-point around the top collecting means. The winding and collecting apparatus further includes a rotation axial means inserting through an rotation axial opening disposed on the central portion of the rotation force asserting means and the bi-level both-end collecting means for providing a rotation shaft therein and for securely maintaining the rotation force asserting means and the bi-level both-end collecting means therein. The rotation force asserting means asserting a rotation force on the bottom collecting means to rotate for collecting the wire from a first end of the wire and the rotation force asserting means further asserting a rotation force on the top collecting means to rotate for collecting the wire from a second end of the wire opposite the first end.

It is an advantage of the present invention that it provides a new automatic-winding collector which is flexibly adaptable to and removable from wires, cords, cables, or ropes in order to save time and efforts of a user in handling and storing very long and entangled wires, cords, cables, or ropes after use.

Another advantage of the present invention is that it provides a new automatic-winding collector which is flexibly adaptable to and removable from electrical cords for application to a DC-source electronic device such as a portable computer in order to improve the reliability and performance.

Another advantage of the present invention is that it provides a new automatic-winding collector which is flexibly adaptable to and removable from wires, cords, cables, and ropes, such that the system design can be simplified without requiring to design a cord collector as a built-in mechanism as part of the original system.

These and other objects and advantages of the present invention will no doubt become obvious to those of ordinary skill in the art after having read the following detailed description of the preferred embodiment which is illustrated in the various drawing figures.

DETAILED DESCRIPTION OF THE PREFERRED EMBODIMENT

Figure 1:
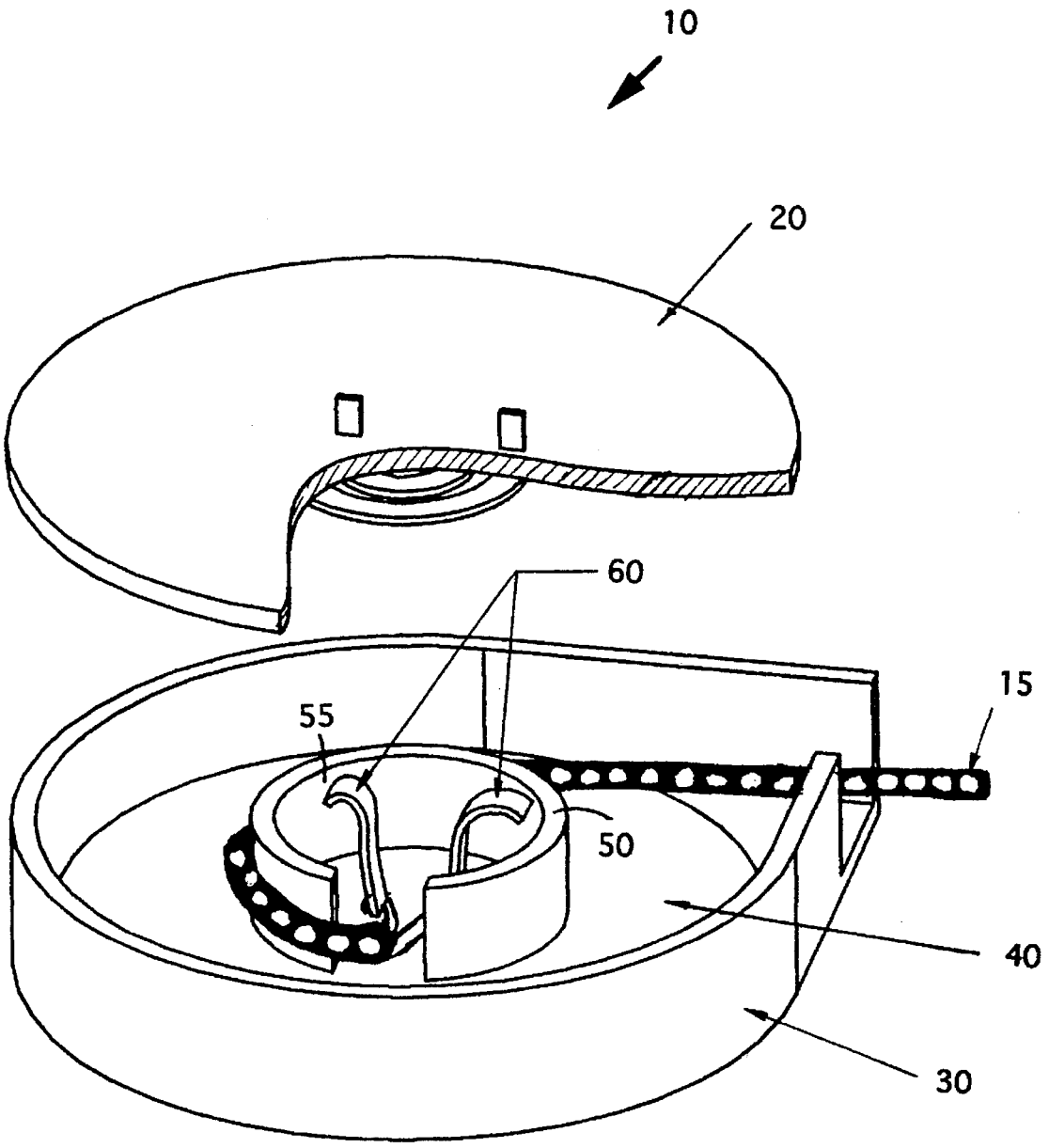
FIGS. 1 shows a conventional cord-winding collector employed by a portable computer.
Figure 2A:
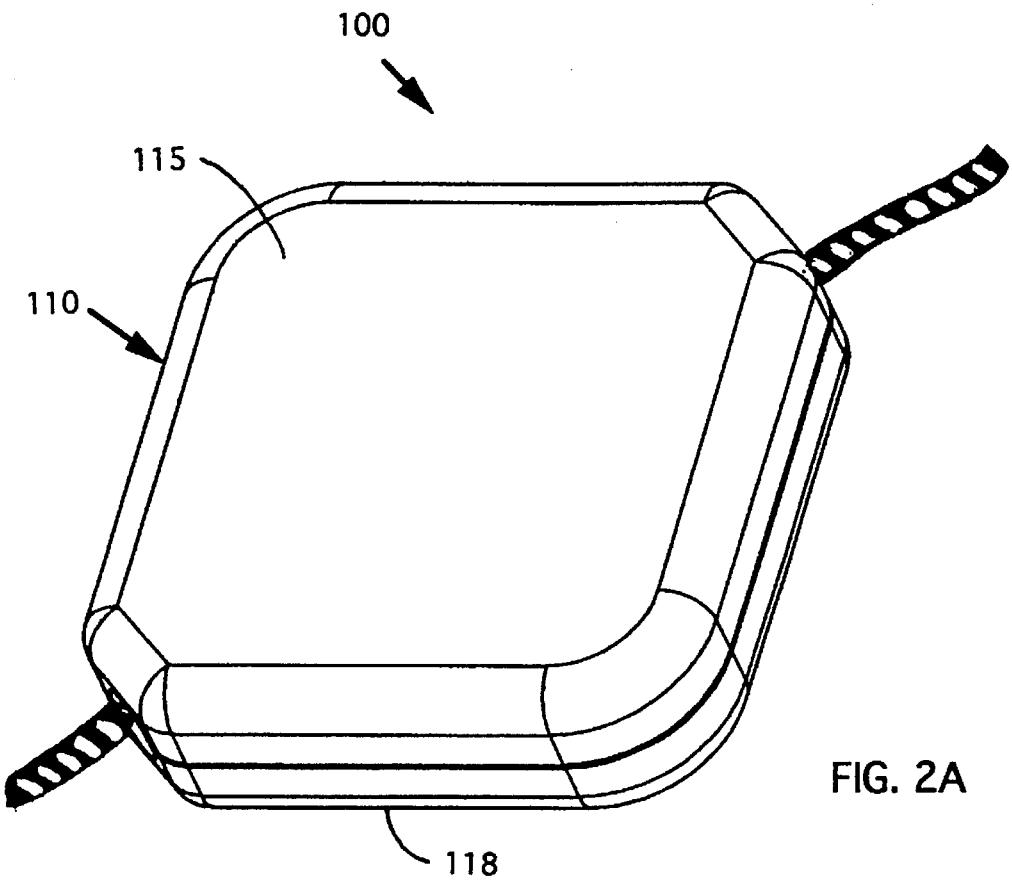
FIG. 2A is a perspective view of a flexibly adaptable automatic winding collector of this invention enclosed in a containing box.
Figure 2C:
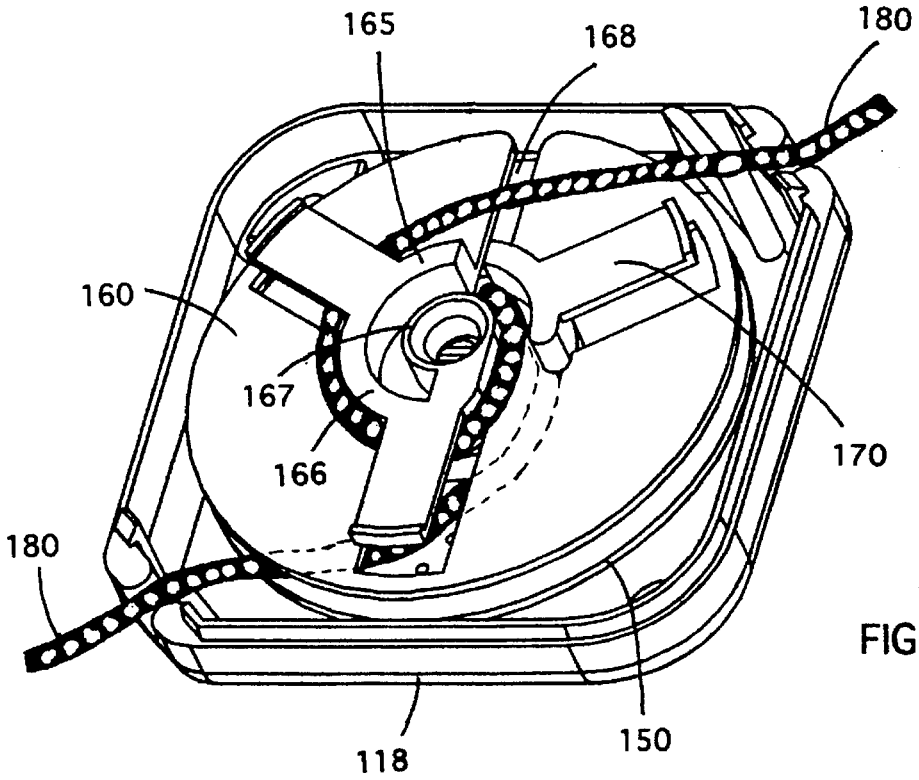
FIG. 2C is a perspective top view of the flexibly adaptable automatic winding collector of FIG. 2A showing a cord adapted therein.
Figure 2B:
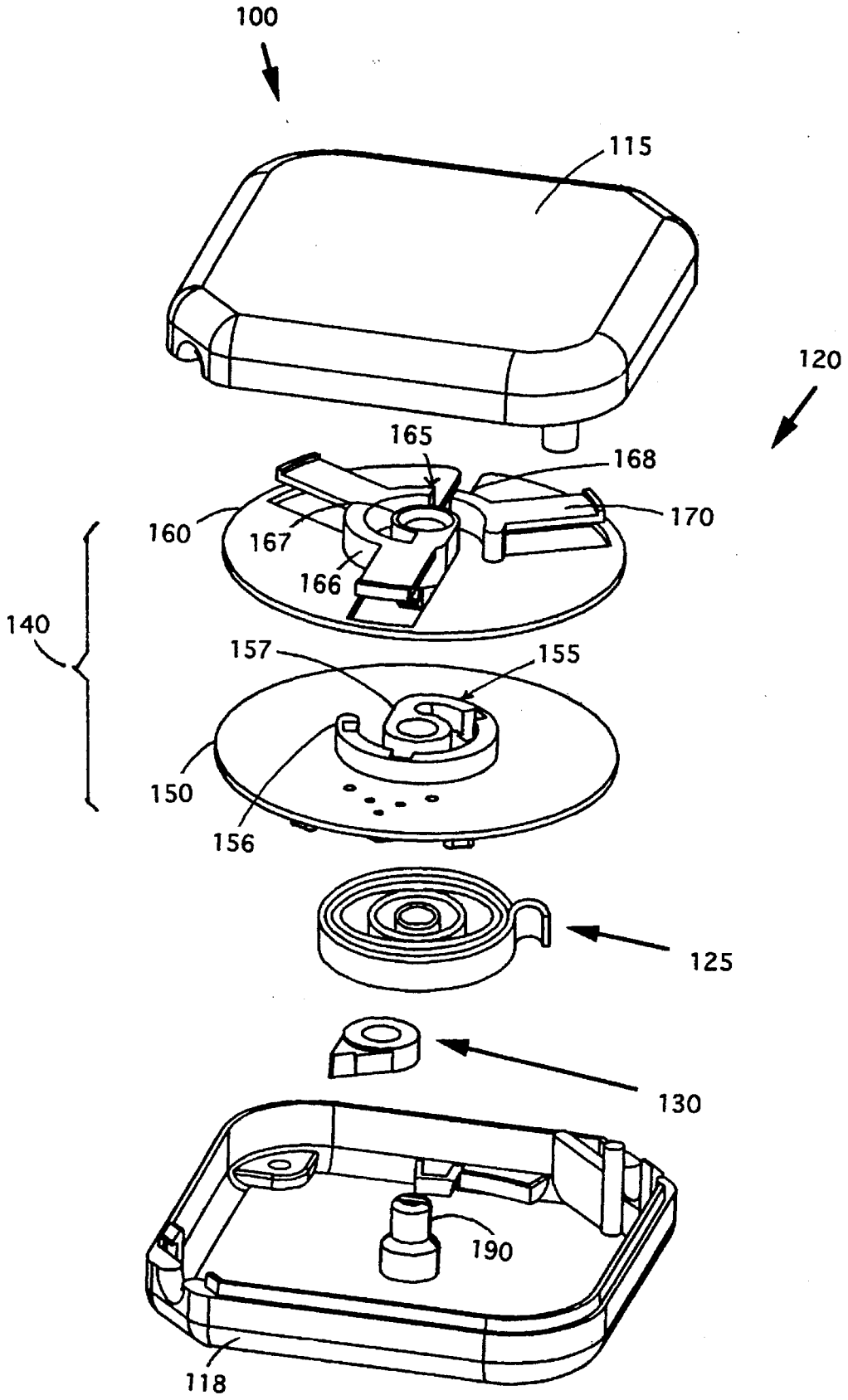
FIG. 2B is an explosive perspective view showing the internal structure of the flexibly adaptable automatic winding collector of FIG. 1.

FIGS. 2A to 2D show an adaptable automatic winder-collector 100 and its internal structure of the present invention. FIG. 2A is an perspective view of the adaptable automatic winder-collector 100 which includes a containing and protecting means 110 which has a shape of a box, including a top cover 115 and a bottom chassis 118, for containing and protecting a flexibly adaptable winding and collecting means 120 with the details of structures shown in FIGS. 2B to 2D. FIG. 2B is an explosive perspective view of the flexibly adaptable winding and collecting means 120 which includes a winding force asserting means, i.e., a volute spring 125, for asserting a winding force, and a stopping means, i.e., a stopper 130, for stopping the winding and collecting action asserted by the winding force asserting means 125. The winding and collecting means 120 also includes a bi-level both-end collecting means 140 which includes two levels of collecting means, i.e., a bottom collecting means which is a first spindle 150, and a top level collecting means which is a second spindle 160. Each of the bottom and the top collecting means, i.e., the first and the second spindles 150 and 160, includes an approximately G-shaped wire-collecting ridge, i.e., a bottom and top G-shaped ridge 155 and 165 respectively. Each of these G-shaped ridges 155 and 165 include an outer ridge forming substantially a circular wire winding ridge 156 and 166 respectively for collecting the wire thereon. Each of these G-shaped ridges 155 and 165 also includes an inner ridge forming substantially concentric circles as an adapting ridge 157 and 167 respectively for flexibly adapting the wire therethrough. The top spindle 160 also includes a wire-through opening means, i.e., a cut-off portion 168 for allowing a wire to pass through from the bottom spindle 150 to the top spindle.

Figure 2D:
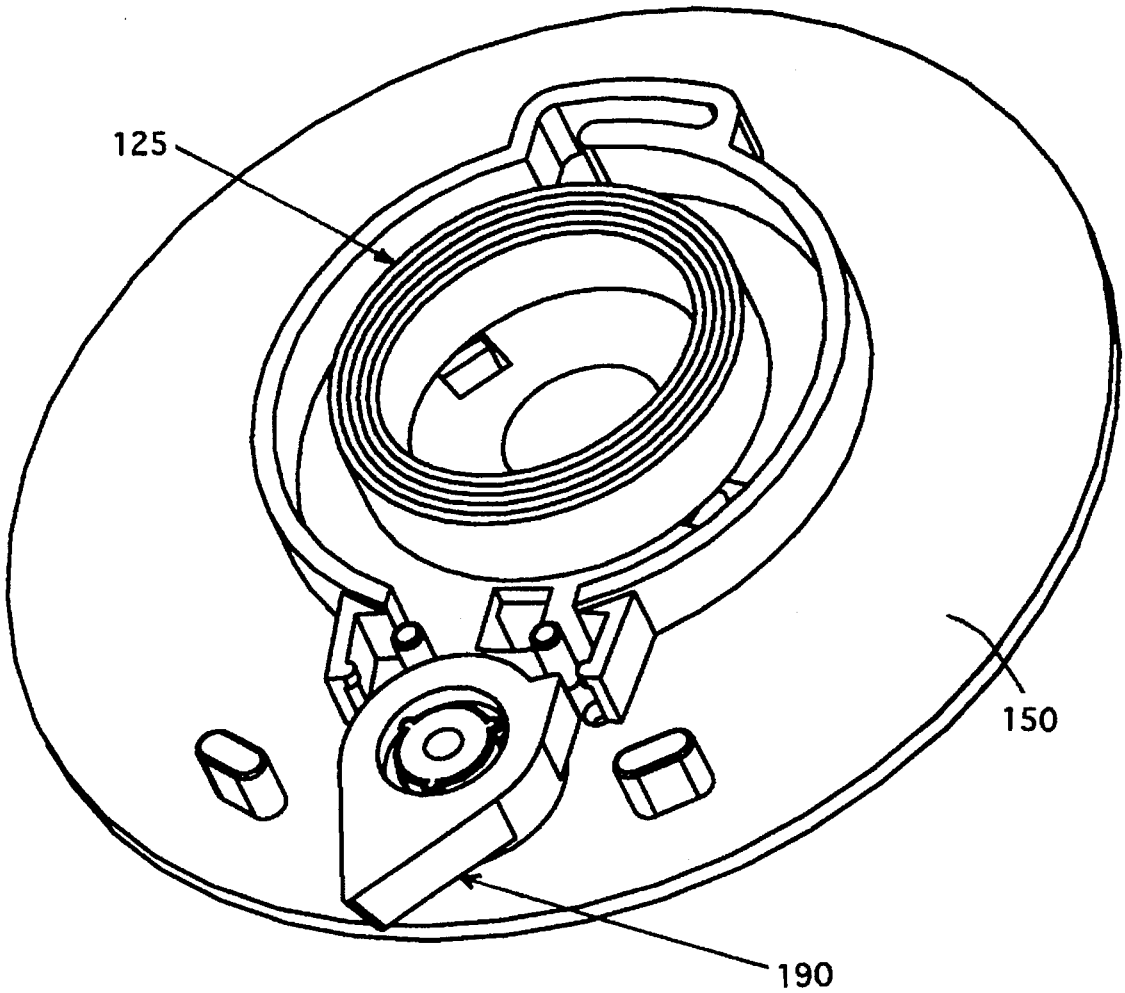
FIG. 2D is a perspective bottom view of the flexibly adaptable automatic winding collector of FIG. 2A showing the position of the stopper.

Referring to FIG. 2C for the mechanism of the winding and collecting actions performed by this bi-level both-end collecting means 120, the wire 180 is first wrapped around the outer ridge 156 on the bottom spindle 155 and then along the ridge near the portion of the opening of the G-shaped ridge 155 on the outer ridge 156, the wire is managed to wrap around the inner adapting ridge 157. The wire 180 then passes through the wire-through opening means 168, i.e., the cutoff segment on the top spindle 160 to wrap around the inner ridge 167 of the top G-shaped ridge 165. The wire then wraps around the outer ridge 166 on the top spindle 160. The top spindle 160 also includes a top limiting-guiding 170 for guiding and limiting the winding of the wire 180 around the outer ridge 166 of the top G-shaped ridge 165. The bi-level both-end collection means 120 further includes a rotation axial means 190 which is attached to the inner surface of the chassis 118 as shown. The rotational axial means 190 is inserted through the central axial openings of the winding force asserting means, i.e., the volute spring 125, the first and the second spindle 150 and 160 of the bi-level both-end collecting means 140 and then attached to the top cover 115. The rotational axial means 190 serves to maintain these components in place and are employed as a rotational shaft for these components to rotate around. FIG. 2D shows a bottom perspective view of the winding and collecting apparatus 100. The details of the stopper 190 is shown. The stopper 190 is employed by a user of the apparatus to stop the winding action of the volute spring 125 by asserting a sudden force on the wire 180. Since the mechanism of the stopper 190 is well known in the art, the details of how the stopper 190 is constructed and how it works to stop the winding action will not be discussed further here.

This invention thus discloses a flexibly adaptable and removable wire winding and collecting apparatus for winding and collecting a long string wire. The apparatus includes a rotation force asserting means 125 for asserting a rotation force. This wire collecting apparatus further includes a bi-level both-end collecting means 140 which includes a bottom collecting means 150 and a top collecting means 160 divided by a dividing surface wherein the dividing surface including a flexibly adapting and removable opening 168 for adapting the wire 180 therethrough at a mid-point on the wire for wrapping a first portion of the wire around the bottom collecting means 150 and a second portion opposite the first portion from the mid-point around the top collecting means 160. The wire collecting apparatus 100 further includes a rotation axial means 190 inserting through an rotation axial opening disposed on the central portion of the rotation force asserting means 125 and the bi-level both-end collecting means 140 for providing a rotation shaft therein and for securely maintaining the rotation force asserting means 125 and the bi-level both-end collecting means 140 therein. The rotation force asserting means 125 asserting a rotation force on the bottom collecting means 150 to rotate for collecting the wire 180 from a first end of the wire and the rotation force asserting means 125 further asserting a rotation force on the top collecting means 160 to rotate for collecting the wire 180 from a second end of the wire opposite the first end. In a preferred embodiment, the wire winding and collecting apparatus 100 further includes a stopping means 130 for a user of the apparatus 100 to stop the rotation of the bottom collecting means 150 and the top collecting means 160. The wire winding and collecting apparatus 100 may also include a top wire guiding and limiting means 170 for guiding and limiting winding of the wire on the top collecting means 160. The wire winding and collecting apparatus 100 may also include a bottom wire guiding and limiting means (not shown), similar to the top wire guiding and limiting means 170, for guiding and limiting winding of the wire on the bottom collecting means 150. As shown in FIG. 2A to 2D, the wire winding and collecting apparatus 100 may also include a containing means 110 for containing and protecting the rotation force asserting means 125 and the bi-level both-end collecting means 140 therein. Furthermore, in a preferred embodiment of the wire winding and collecting apparatus 100, the top collecting means 160 is a first rotational spindle with top circular collecting ridge 165 thereon around the rotation axial means 190 for collecting the wire 180 thereon and the bottom collecting means is a second spindle 150 with bottom circular collecting ridge thereon around the rotation axial means 190 for collecting the wire 180 thereon. Furthermore, the rotation force asserting means is a volute spring 125.

By providing the opening 168, i.e., the flexibly adapting and removable opening, a wire can be conveniently adapted to or removed from the winding and collecting apparatus 100 from a mid-point of long string of wire 180. The action of collecting wire is not required to start from a free end of a wire. It provides the convenience and flexibility for a long string of wire to be wound and collected on the apparatus without requiring to look for a free end. The time consuming and awkward task of wrapping a long and entangled wire or rope can be now conveniently completed by adapting the wire or rope to the collector and then winding and collecting it therein.

The present invention thus discloses a new and non-obvious automatic-winding collector in order to overcome the difficulties encountered in the prior art. Specifically, this new automatic-winding collector which is flexibly adaptable for application to different wires, cords, cables, or ropes to achieve space saving and operational conveniences. This automatic-winding collector can be adapted for use to wind and collect different wires, cords, cables, or ropes to save time and efforts of a user in handling and storing very long and entangled wires, cords, cables, or ropes after use. For a DC-source electronic device such as a portable computer, the reliability and performance are improved by the use of this automatic winder-collector. Furthermore, by the use of this flexibly adaptable winder-collector, the system design can be simplified without requiring to design a cord collector as a built-in mechanism as part of the original system.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

I claim:

1. A bi-level both-end wire collecting drum adaptable to a wire winding and collecting apparatus for engaging a rotation force asserting means for rotational winding and collecting a wire therein, said wire collecting drum comprising:

a bottom wire collecting means including a bottom spindle with a bottom wire collecting ridge disposed substantially in a central portion of said bottom spindle;

a top wire collecting means including a top spindle with a top wire collecting ridge disposed substantially in a central portion of said top spindle;

said top spindle including a tilted surface portion having a slightly tilted surface for constituting a wire adapting and removing opening extended axially from said center portion of said top spindle to an outer edge;

said top wire collecting ridge in said center portion of said top spindle constituting a partial top circular ridge having a top ridge opening disposed at said wire adapting and removing opening; and said bottom wire collecting ridge in said center portion of said bottom spindle constituting a partial bottom circular ridge having a bottom ridge opening aligned with said wire adapting and removing opening wherein said bottom wire collecting ridge securely engaging said top wire collecting ridge constituting a hi-level transition portion for allowing said wire to smoothly pass from said bottom wire collecting ridge to said top wire collecting ridge for smooth and continuous winding and collecting said wire therein.

2. A wire winding and collecting apparatus comprising:

a bi-level both-end wire collecting drum includes a bottom wire collecting means including a bottom spindle with a bottom wire collecting ridge disposed substantially in a central portion of said bottom spindle;

said bi-level both-end wire collecting drum further includes a top wire collecting means including a top spindle with a top wire collecting ridge disposed substantially in a central portion of said top spindle;

said top spindle including a tilted surface portion having a slightly tilted surface for constituting a wire adapting and removing opening extended axially from said center portion of said top spindle to an outer edge;

said top wire collecting ridge in said center portion of said top spindle constituting a partial top circular ridge having a top ridge opening disposed at said wire adapting and removing opening;

said bottom wire collecting ridge in said center portion of said bottom spindle constituting a partial bottom circular ridge having a bottom ridge opening aligned with said wire adapting and removing opening wherein said bottom wire collecting ridge securely engaging said top wire collecting ridge constituting a bi-level transition portion for allowing a wire to smoothly pass from said bottom wire collecting ridge to said top wire collecting ridge; and a rotation force asserting means for securely engaging said wire collecting drum for asserting a rotational force thereon for rotationally winding and collecting said wire therein.

3. The wire winding and collecting apparatus of claim 2 further comprising:

a containing box for containing said bi-level both-end wire collecting drum and said rotation force asserting means engaged thereon;

said containing box further includes a first wire-through-hole disposed near an outer edge of said top spindle; and said containing box further includes a second wire-through-hole disposed near an outer edge of said bottom spindle traversely opposing said first wire-through-hole.

4. The wire winding and collecting apparatus of claim 3 wherein:

said containing box further includes an upper-shell and a lower-shell wherein said upper-shell and lower shell are removably attached for constituting said containing box.

5. The wire winding and collecting apparatus of claim 3 wherein:

said containing box further includes a rotation-axle securely disposed in a center portion of said containing box for engaging and providing a rotational axle means for allowing said rotation force asserting mean and said top and bottom spindles to rotate thereon.

6. The wire winding and collecting apparatus of claim 5 wherein:

said containing box further includes a rotation stop means securely disposed on said contain box near an outer edge of said rotation force asserting means for stopping a rotation movement of said rotation force asserting means and said top and bottom spindles.

7. The wire winding and collecting apparatus of claim 3 wherein:

said rotation force asserting means is a volute spring securely engaged to said bottom spindle.

8. A wire winding and collecting apparatus comprising:

a bi-level both-end wire collecting drum includes a bottom wire collecting means including a bottom spindle with a bottom wire collecting ridge disposed substantially in a central portion of said bottom spindle;

said bi-level both-end wire collecting drum further includes a top wire collecting means including a top spindle with a top wire collecting ridge disposed substantially in a central portion of said top spindle;

said top spindle including a tilted surface portion having a slightly tilted surface for constituting a wire adapting and removing opening extended axially from said center portion of said top spindle to an outer edge;

said top wire collecting ridge in said center portion of said top spindle constituting a partial top circular ridge having a top ridge opening disposed at said wire adapting and removing opening;

said bottom wire collecting ridge in said center portion of said bottom spindle constituting a partial bottom circular ridge having a bottom ridge opening aligned with said wire adapting and removing opening wherein said bottom wire collecting ridge securely engaging said top wire collecting ridge constituting a bi-level transition portion for allowing a wire to smoothly pass from said bottom wire collecting ridge to said top wire collecting ridge;

a rotation force asserting means including a volute spring for securely engaging said wire collecting drum for asserting a rotational force thereon for rotationally winding and collecting a wire therein;

a containing box for containing said bi-level both-end wire collecting drum and said rotation force asserting means securely engaged thereon;

said containing box further includes an upper-shell and a lower-shell wherein said upper-shell and lower shell are removably attached for constituting said containing box;

said containing box further includes a first wire-through-hole disposed on said top-shell near an outer edge of said top spindle and a second wire-through-hole disposed on said bottom-shell near an outer edge of said bottom spindle traversely opposing said first wire-through-hole;

said containing box further includes a rotation-axle securely disposed in a center portion of said containing box for engaging and providing a rotational axle means for allowing said rotation force asserting mean and said top and bottom spindles to rotate thereon; and said containing box further includes a rotation stop means securely disposed on said contain box near an outer edge of said rotation force asserting means for stopping a rotation movement of said rotation force asserting means and said top and bottom spindles.

* * * * *